United States Patent [19]

Andersson et al.

[11] 4,222,417

[45] Sep. 16, 1980

[54] FILLER PIPE FOR PACKING MACHINES

[75] Inventors: Pär M. Andersson, Bjärred; Bengt A. Rosberg, Höör, both of Sweden

[73] Assignee: Tetra Pak International AB, Lund, Sweden

[21] Appl. No.: 899,973

[22] Filed: Apr. 25, 1978

[30] Foreign Application Priority Data

Apr. 25, 1977 [SE] Sweden ..... 7704706

[51] Int. Cl.[2] ..... B65B 3/04; B05B 1/14

[52] U.S. Cl. ..... 141/392; 53/579; 141/286; 239/553.5

[58] Field of Search ..... 53/579; 138/39, 37; 141/286, 392, 325; 222/565; 239/553, 553.5, 502, 568

[56] References Cited

U.S. PATENT DOCUMENTS 2,224,450 12/1940 Scofield ..... 239/553 X 3,918,237 11/1975 Stark ..... 53/579 X

*Primary Examiner*—Frederick R. Schmidt

*Attorney, Agent, or Firm*—Burns, Doane, Swecker & Mathis

[57] ABSTRACT

A filler pipe for filling containers of a packing machine includes a nozzle part having an elongated base plate. One side of the base plate has a plurality of guide vanes which together with the base plate and a material forming a portion of the containers will provide filling channels for a fluid. The guide vanes may be straight or curved and may be arranged so as to lie at a periphery of the base plate. The base plate may preferably have a triangular shape with a generally decreasing width. In another embodiment of the present invention, a distribution chamber is provided beneath the base plate with a plurality of holes in the base plate permitting communication between the distribution chamber and the filling channels. In this embodiment, the base plate is preferably rectangular in shape with the guide vanes extending completely across the base plate.

11 Claims, 6 Drawing Figures

FILLER PIPE FOR PACKING MACHINES

Figure 1:
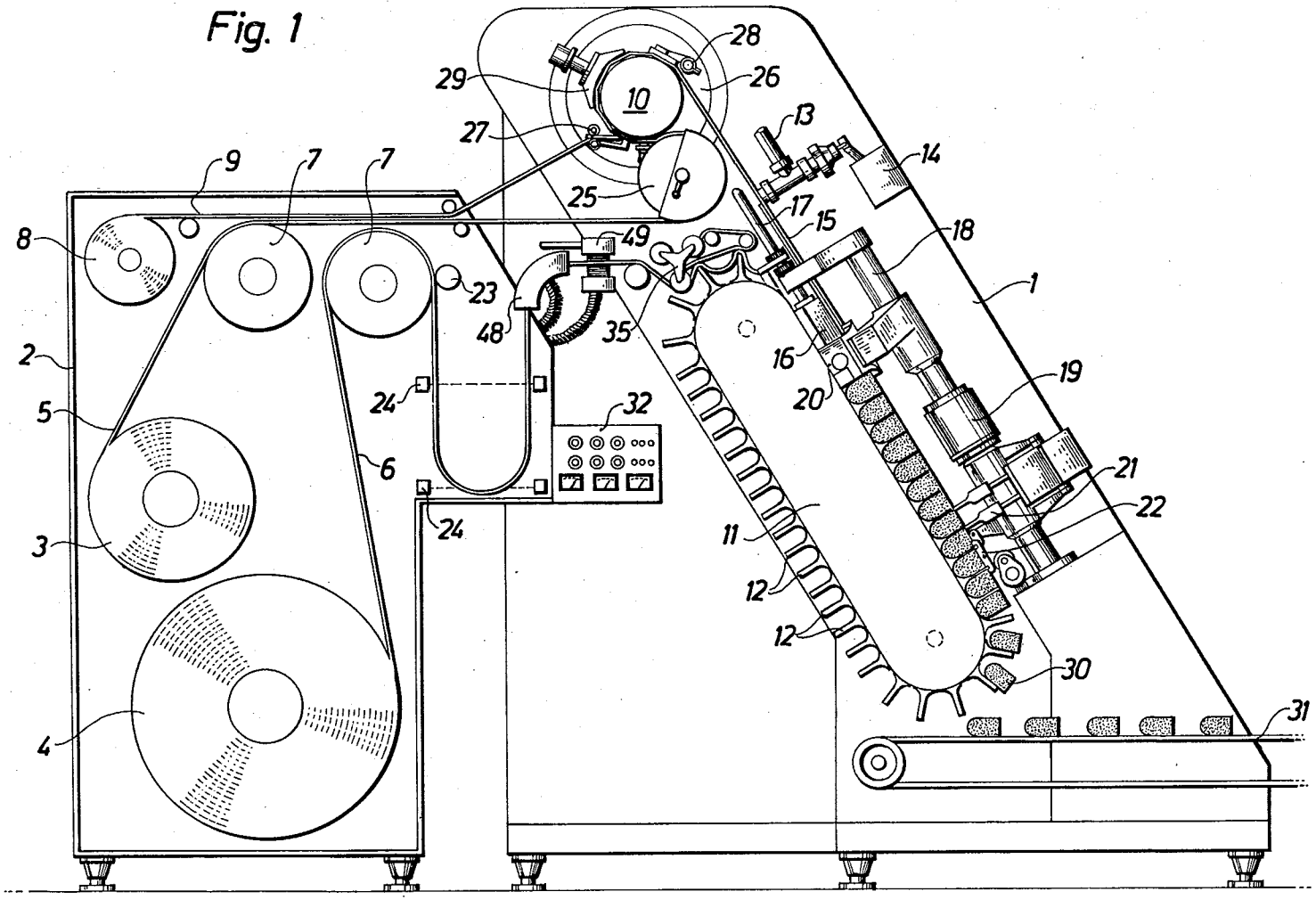

The present invention relates to a filler pipe for the filling with liquid contents of a row of mutually connected packing containers surrounding the filler pipe, which filler pipe comprises a delivery pipe and a nozzle part.

Packing machines of the type which from a web-type material manufacture packing containers which are filled with liquid contents and then closed, frequently work according to a principle which in short provides that the packing material web or webs whilst moving substantially downwards through the packing machine are first converted to a row or tube of connected packing containers which are in communication with each other. The row of packing containers is formed around an elongated filler pipe and is filled continuously with the intended contents. At the bottom end of the row a gradual sealing off of filled packing containers from the connected row takes place with the help of sealing jaws and a cutting device. During manufacture the row of connected packing containers is also frequently processed by means of shaping rolls or the like so as to give the packing containers the desired shape.

With regard to the filling of the connected row of packing containers with the desired contents, two main principles may be distinguished, namely in the first place a continuous delivery of the contents at such a flow rate that the level of contents is maintained substantially constant in the row of semi-finished packing containers moving downwards through the packing machine. This filling method is particularly suitable for the total filling of the packing containers, that is to say, where the finished packing containers are without any air space. In another frequently used method for the supply of the intended contents, the contents are delivered intermittently and in such a volume that normally only the packing container located at the bottom of the row of connected packing containers (that is to say, the container situated closest to the sealing jaws) is filled with the intended contents. This filling method is particularly suitable when the finished packing containers are to have a certain amount of air space.

In the abovementioned types of machines the filler pipe consists of a conventional pipe which at its bottom end is cut off in such a manner that the contents can freely flow out into the connected row of packing container blanks. This filler pipe functions well in the filling of products with relatively high viscosity and products which do not give rise to any strong froth formation. Where products with a tendency towards strong froth are concerned, however, difficulties arise since the air bubbles mixed into the contents when froth is formed prevent the complete filling of the packing containers and sometimes also lead to unsatisfactory volume accuracy. This problem is stressed especially when packing machines operate at high speed and the contents consequently have to be delivered at high speed through the filling pipe.

Further problems arise when relatively narrow filler pipes are used, which is necessary, e.g. in cases when the packing material webs and/or rows of packing container blanks during the movement downwards through the packing machine are to be processed by means of shaping tools or the like which partly compress the connected packing containers and limit the space for the filler pipe.

It is an object of the present invention to eliminate the abovementioned disadvantages and provide a filler pipe for a packing machine which is simple to manufacture and does not contain unnecessarily narrow passages or passages of irregular shape which render cleaning more difficult.

It is a further object of the present invention to provide a filler pipe which has a delivery channel of a substantially constant cross-sectional area which gradually widens to a nozzle part, thus ensuring that the product is not subjected to sudden changes in speed or pressure which can have a harmful effect on the quality of the product, which is particularly important for certain sensitive products, e.g. whipping cream.

The abovementioned and other objects have been achieved in accordance with the invention in that a filler pipe for the filling with liquid contents of a row of mutually connected packing containers surrounding the filler pipe, which filler pipe comprises a delivery pipe and a nozzle part, has been given the characteristic that the outlet end of the delivery pipe opens into a number of channels arranged in the nozzle part which are directed at an angle to the longitudinal direction of the filler pipe. As a result the outflowing contents are distributed over a larger surface at the same time as they are diverted in lateral direction so that froth formation is reduced.

A preferred embodiment of the filler pipe in accordance with the invention has been given the further characteristic that the nozzle part comprises an elongated base plate, one side of which is provided with a number of guide vanes which are adapted so as to cooperate with the material forming the packing containers. This construction means that during operation the base plate together with the guide vanes and the material forming the packing containers will together form the channels mentioned earlier, which means that the construction is easily accessible and simple to clean.

A further preferred embodiment of the arrangement in accordance with the invention has been given the further characteristic that the outlet end of the delivery pipe has the form of a distribution chamber situated underneath the base plate, whose wall coinciding with the base plate is perforated so as to allow a flow of contents from the interior of the distribution chamber to the channels formed by the guide vanes. A filler pipe with this characteristic has proved to provide great accuracy of volume on filling of totally filled packages, especially in conjunction with contents which are mobile and do not have the tendency to thicken or to form lumps on mechanical processing.

In the foregoing embodiment of the filler pipe in accordance with the invention, it has proved appropriate to design the guide vanes as transverse partitions extending between the longitudinal side edges of the base plate. This construction is mechanically simple to manufacture.

A further preferred embodiment of the filler pipe in accordance with the invention has been given the further characteristic that the delivery pipe opens at one end of the upper side of the base plate.

A further preferred embodiment of the arrangement in accordance with the invention has been given the further characteristic that the guide vanes are in the form of partitions projecting from the surface of the base plate which extend from the longitudinal edges of the base plate in the direction of the longitudinal centre line of the plate.

A further preferred embodiment of the arrangement in accordance with the invention has been given the further characteristic that the base plate has a central, substantially triangular, portion which is free of guide vanes and which is limited by the end sections of the guide vanes facing towards the centre line of the base plate and by the orifice of the delivery pipe. This design of the nozzle part means a direct division of the jet of contents issuing from the orifice of the delivery pipe into a number of partial flows directed sideways which are distributed along a relatively long portion of the centre axis of the filler pipe.

More particularly, a further embodiment of the arrangement in accordance with the invention is characterized in that the outflow openings directed sideways of the nozzle part are situated along a distance which corresponds to the length of at least two consecutive packing container blanks.

A further preferred embodiment of the arrangement in accordance with the invention has been given the further characteristic that the end sections of the guide vanes facing towards the centre line of the base plate are curved in the direction of opening of the delivery pipe which causes less turbulence on deflection of the contents issuing from the orifice of the delivery pipe.

Finally, a further embodiment of the arrangement in accordance with the invention has been given the characteristic that the height of the guide vanes gradually diminishes from a height corresponding to the thickness of the delivery pipe at the end of the nozzle part adjoining the delivery pipe to a height corresponding to the thickness of the base plate at the opposite end of the base plate.

Preferred embodiments of the arrangement in accordance with the invention will now be described in more detail with reference to the enclosed schematic drawings which only shows the parts necessary for the understanding of the invention.

Figure 2:
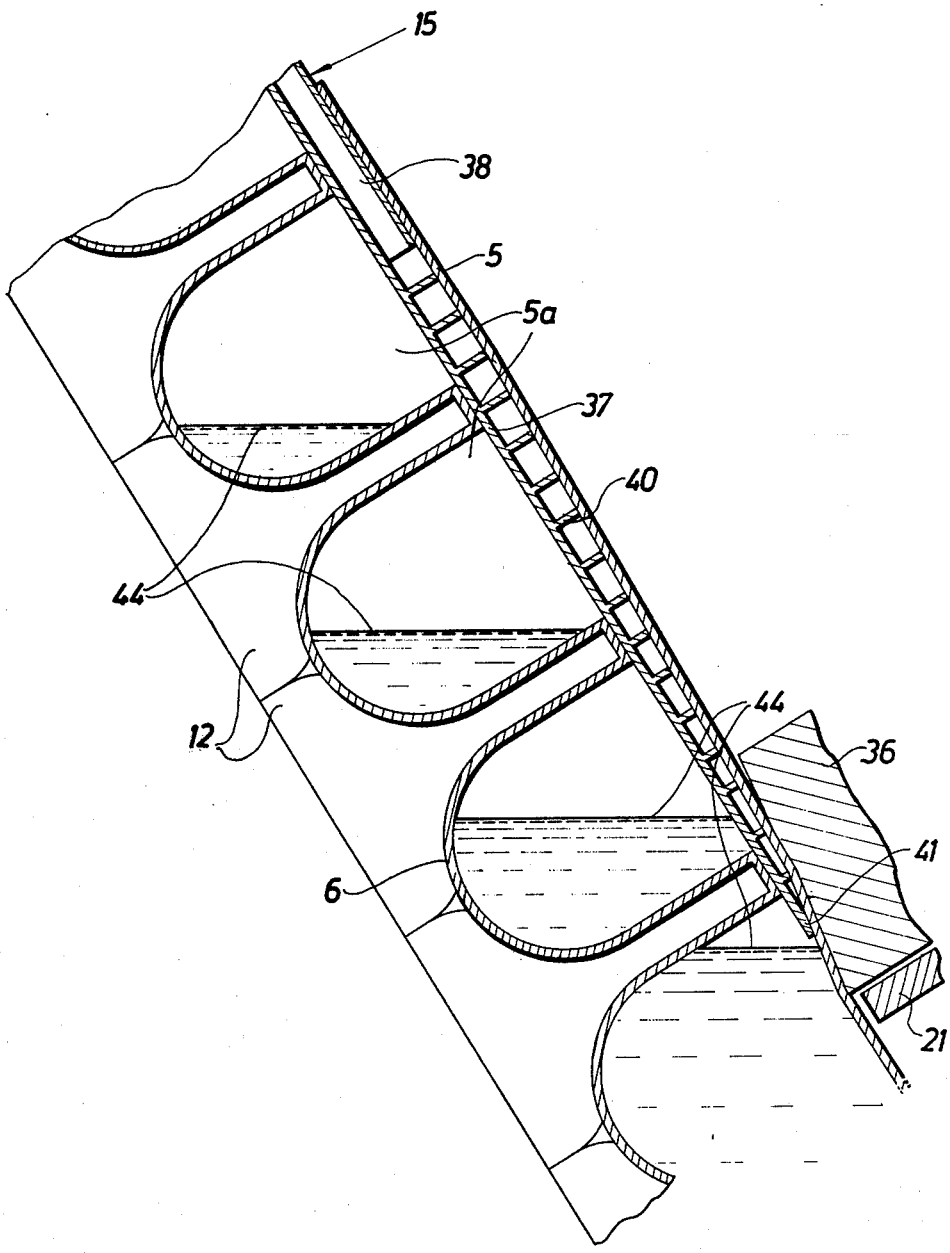
Figure 3:
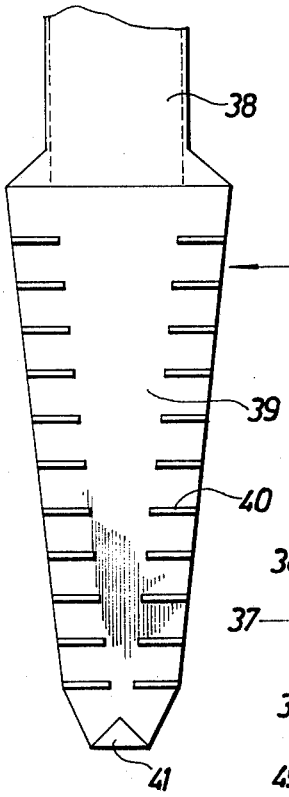
Figure 4:
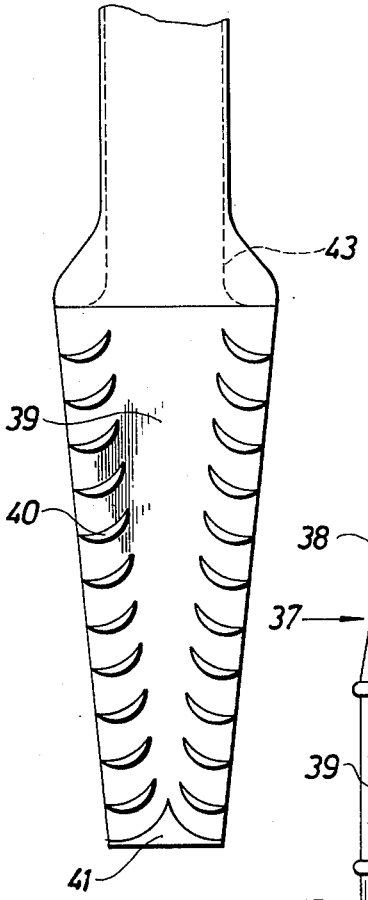
Figure 5:
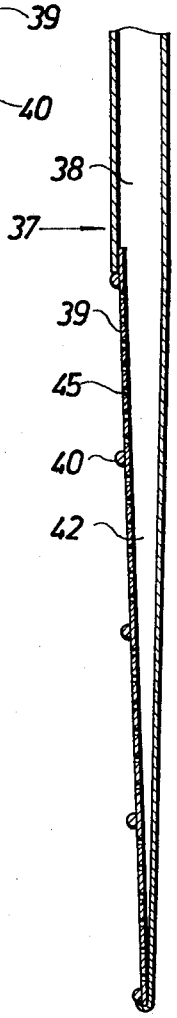
Figure 6:
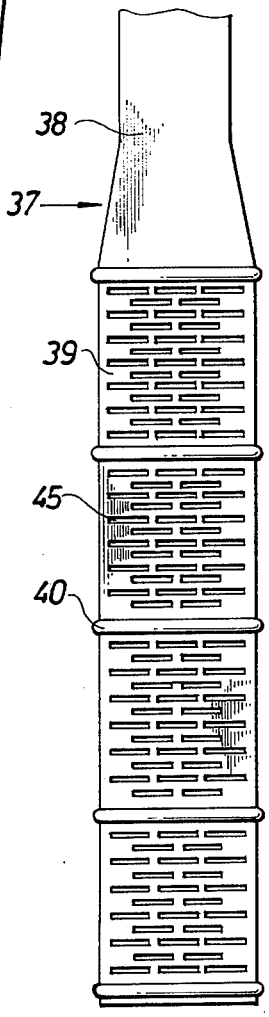

FIG. 1 shows a packing machine known in itself with a filler pipe in accordance with the invention, FIG. 2 shows on a larger scale and in section a portion of the filler pipe in accordance with the invention on the packing machine according to FIG. 1, FIG. 3 shows the lower end of a filler pipe with a nozzle part in accordance with the invention which corresponds to the nozzle part shown in FIG. 2, FIG. 4 shows a further embodiment of a filler pipe with a nozzle part in accordance with the invention, FIGS. 5 and 6 show a section through, and an elevation of, the lower end of a filler pipe in accordance with the invention with a further embodiment of a nozzle part.

In FIG. 1 is shown a front elevation of a known packing machine with a filler pipe in accordance with the invention, the frame of the packing machine proper being designated 1 and a packing material section being designated 2.

The packing material section 2 comprises a number of so-called roll stands containing magazine rolls of packing material. The rolls 3 and 4 carry packing material webs which may consist e.g. of extruded foamed plastic web of polystyrene material covered on both sides with layers of homogeneous polystyrene. The packing material webs 5 and 6 are rolled off the magazine rolls 3 and 4 and are passed over the guide rolls 7. The magazine roll 8 carries strip material 9 of homogeneous plastic material which strip material 9 is intended for use as a removable cover material over the opening in the finished packages.

The packing machine proper, as mentioned above, consists of a frame 1 which supports a rotating drum 10 over which the packing material web 5 is passed and on which processing operations are carried out at stations along the periphery of the drum. The packing machine comprises moreover an arrangement 11 for ths shaping of the web 6. The arrangement 11 comprises movable moulds 12 which are fitted to an endless chain which in the figure shown move in clockwise direction. In FIG. 1 is also shown a delivery line 13 for the material to be filled into the containers, a control valve 14 for the controlling of the amount of contents delivered, and a filler pipe 15 which will be described in greater detail in the following. A heating device is designated 16 and a delivery line for air 17. A column capable of reciprocating movement is designated 18 and bearings fixed in the machine frame 1 for the guidance of the column are marked 19. The column supports a folding device 20, a sealing device 21 and a cutting device 22, the two first mentioned of which move together with the column 18 in its reciprocating movement, which is adapted so that the column moves synchronously with the moulds 12 in its downwards movement whilst the return movement upwards is faster. Directly before the sealing device 21 there is moreover a displacement and shaping device 36.

The packing machine operates as follows:

A first packing material web 6 provided with crease lines is rolled off the magazine roll 4 and is passed over a guide roll 7. The packing material web is rolled off with the help of a driving roll 23 which is controlled by means of a photocell unit comprising two photocells 24. If too much packing material web 6 is rolled off by means of the driving roll 23, the loop of packing material web formed will cover the lower one of the photocells 24, the controller will receive a pulse and the driving device for the driving roll 23 will be stopped (FIG. 1). This means that the feed of packing material will be interrupted and the loop of packing material will diminish. When the loop has become so small that the top photocell 24 is no longer covered, the feed of packing material restarts with the help of the driving roll 23. The packing material web 6 is brought into contact with the moulds 12 on the moulding arrangement 11, wherein the moulds 12 are fitted on an endless chain which moves at constant speed in a closed track. With the help of a moulding tool 35 the packing material web 6 (possibly after heating by a heating unit 48, 49 which with the help of hot air heats and softens the passing material web) is made to lie against the moulds 12 the web 6 being folded so as to form an endless row of U-shaped parts which with the help of the forming arrangement 11 are made to move substantially downwards at a constant speed.

The second packing material web 5 is rolled off its magazine roll 3 and is passed over a guide roll 25, whereupon it is made to rest against the feed drum 10. The latter is provided with a number of sections or shaping surfaces each of which has a width which substantially corresponds to the distance between two successive moulds 12 on the forming arrangement 11. The feed drum 10 rotates at constant speed whilst an outer rim or oscillator plate 26 performs a reciprocating driving movement around the drum 10. The plate 26 supports processing devices such as a hole punch and a cover strip applicator 27, shaping and cutting elements 28 and a heating element 29. When the web 5 with the help of the feed drum 10 is conducted past the processing stations 27-20 emptying holes are punched out on the web, a cover strip is placed over the emptying holes, heating and possibly thermoforming of the web takes place as well as a cutting off of the edge zones of the web substantially rectangular to the longitudinal direction of the web. From the magazine roll 8 a strip 9 of homogeneous plastic material is rolled off which strip is applied with the help of the cover strip applicator 27 over the emptying hole produced in the web 5 and fixed to the web 5 so that the emptying holes are covered. Moreover, the front part of the strip 9 is cut off by means of the cover strip applicator 27, so that the cover strip part applied over the emptying hole is severed from the strip 9. The edge zones of the web 5 provided with emptying hole and opening device have been converted by the cutting process to a series of tabs jutting out sideways (5*a* in FIG. 2), whose length practically corresponds to the height of the moulds 12. The web is fed with the help of the feed drum 10 at a speed which is the same as the speed of movement of the moulds 12, the web 5 being conducted up to the moulds 12 and placed with its central portion over the tops of the same, whilst the edge zones of the web, converted to tabs or lugs, project outside the moulds 12. With the help of a controller (not shown on the drawing) the web 5 is advanced in such a manner that the slots in the web are placed opposite the transverse flanges or partitions of the moulds 12.

Whilst the web 5 with the help of the feed drum 10 is fed synchronously with the movement of the moulds 12, the column 18 assumes an upper limit position and starts a downward movement which is then also synchronous with the movement of the moulds 12. The column 18 supports a heating device 16 which via a pipe 17 can be conducted to an air source, and with the help of the heating device 16 hot air is blown against the underside of the edge zones or lugs of the web 5, the plastic material being softened and activated for sealing, and at the same time the edges of the web 6 are also heated by hot air being blown against the web edge zones exposed at the side edges of the moulds.

At the same time as the heating of the zones on the webs 5 and 6, which are intended to be sealed to one another, is carried out by means of the heating device 16, the lugs or tabs on the web 5, heated up during the earlier working stroke of the column 18, are folded down so as to make contact with the edge zones of the web 6 situated outside the moulds 12 which have also been heated previously, as a result of which the combined parts of the webs fuse together to a mechanically durable and consistent seal which is stabilized in that the folding tool 20 cools down the sealing area during the time it is in engagement with the folded down parts of the web 5. When the webs 5 and 6 have been combined with one another, owing to the side sealing in the manner described above, the material to be filled into the containers is delivered through the filler pipe 15 which is arranged underneath the web 5 but above the tops of the moulds 12, and the compartment-like space formed underneath the web 5 is filled with the intended contents. After displacement of excess contents and pressing together of the webs by means of the device 36, the said space is sealed off by means of the sealing device 21 to closed units, in that the web 5 is sealed to the parts of the web 6 which lie over the tops of the upright parts of the moulds 12. The sealing device 21 for its part is also attached on the column 18 and follows the column in its reciprocating movement, which means that the sealing takes place whilst the column moves downwards synchronously with the moulds. The closed units formed are finally separated from one another with the help of cutting element 22 which severs the units from one another by cutting through the sealing zones which have been produced by means of the sealing device 21.

The filled and closed packing units 30 are then conveyed at the bottom end of the mould belt to a conveyor 31 for removal and packing into boxes or the like.

The packing machine can be operated by means of a control and instrument panel 32 containing the required controls and the instruments to indicate the temperature in the different heating zones, etc.

After this description of a packing machine with a filler pipe 15 in accordance with the invention, different embodiments of the filler pipe will now be described in detail with reference to FIGS. 2–6.

In FIG. 2 is shown in section a part of the moulds 12 arranged on the mould chain, the bottom end of the filler pipe 15 with a nozzle part 37, the two material webs 5 and 6 partly formed to packing containers, the displacement and shaping device 36 and a sealing device 21.

The bottom end of the filler pipe shown in FIG. 2 is also shown in FIG. 3 where it can be seen more clearly how the filler pipe comprises a delivery pipe 38 with flattened cross-section and a nozzle part 37 fixed to the bottom end. The nozzle part 37 comprises an elongated base plate 39, at one short side of which opens the delivery pipe 38. The base plate 39 tapers in form of a triangle in the direction away from the delivery pipe 38 and is provided on its upper side with a number of guide vanes 40. The guide vanes 40 extend transversely in relation to the centre axis of the filler pipe and are arranged in rows along the two longitudinal side edges of the base plate. The guide vanes are arranged in pairs opposite one another, the distance between the two guide vanes included in one guide vane pair being greatest at the end of the base plate to which the delivery pipe 38 is connected and smallest at the narrow end of the base plate opposite. At the finishing end of the base plate 39 there is a further guide vane 41 of a different, substantially triangular shape.

The base plate 39 is fixed to the bottom end of the filler pipe 38 in such a manner that the underside of the base plate constitutes a direct continuation of the underside of the flattened delivery pipe 38, which is clearly evident from FIG. 2. It can also be seen from FIG. 2 that the first pair of guide vanes 40 (i.e. the guide vane pair situated closest to the delivery pipe 38) is designed with a height which corresponds to the corresponding height of the delivery pipe 38 whilst remaining guide vane pairs are of gradually diminishing height so that the nozzle part in profile (FIG. 2) tapers substantially linearly towards its pointed end, where the centrally placed triangular guide vane 41 has a height which only slightly exceeds the thickness of the base plate 39.

The nozzle piece 37 is symmetrical in relation to the centre line of the filler pipe and the distance between the finishing end of the guide vanes facing the centre line is consequently equally short in pairs. The topmost guide vane pair (that is to say, the guide vane pair situated closest to the delivery pipe 38) has a mutual distance between ene surfaces facing one another which substantially agrees with, or is slightly smaller than, the corresponding width of the adjoining orifice end of the delivery pipe 38. The distance between the guide vane end surfaces facing one another thereafter gradually and linearly diminishes in the direction of the bottom end of the nozzle part, so that the bottom pair of guide vanes 40 has a very small mutual distance.

When the filler pipe in accordance with the invention is used in a packing machine of the type described earlier, the nozzle part of the filler pipe is in the position which is shown in FIG. 2, that is to say, it is at the bottom end of the row of connected packing containers and is surrounded by the two packing material webs 5 and 6. The packing material web 6, as described earlier, has been given a shape which corresponds to the U-shaped receses in the moulds 12 and it is thus moved, simultaneously with the chain of moulds 12, gradually downwards through the packing machine. The packing material web 5 is connected by means of the lugs 5*a* to the edge zones of the packing material web 6, whilst the back of the material web 5 extends over the delivery pipe and the upper side of the nozzle part. The nozzle part 37 more particularly is so placed in the row of the connected packing containers that its plane underside is in contact with the portions of the packing material web 6 sliding past which extend over the top surfaces of the moulds 12, at the same time as the central or back portions of the material web 5 is in contact with, and slides over, the upper edge surfaces of the guide vanes 40 and 41. In the course of this, a gradual displacement of the central portion of the material web 5 in the direction of the material web 6 takes place with the help of the shaping tool 36, so that the said central portion of the material web 5 is combined with the parts of the material web 6 placed over the top surface of the moulds 12 at the bottom end of the nozzle part where they are heat sealed to one another with the help of the reciprocating sealing jaws 21, so that a closed packing container is formed.

During the movement downwards through the machine of the two material webs 5 and 6 the material to be filled into the container is being supplied continuously via the filler pipe. The said contents issue through the orifice of the filler pipe over the free triangular surfaces on the upper side of the base plate 39, whereupon they come into contact with the inner ends of the guide vanes 40. Since the distance between the end faces of the guide vanes 40 facing one another gradually diminishes, the amount of contents issuing from the orifice of the delivery pipe will be collected by the guide vanes 40 and be gradually deflected so that it flows out through the channels, directed in substantially rectangular manner towards the centre line of the delivery pipe, which are formed by the base plate 39, the guide vanes 40 and the central portion of the packing material web 5 resting against the upper edge surface of the guide vanes 40. The nozzle part 37 has a smaller width than the central portion of the packing material web 5, and the flow produced through the outflow channels will thus flow outwards along the central portion of the material web 5 until the jets meet the folded down side lugs 5*a*, which break the jets and cause the contents to fill the U-shaped parts of the packing material web 6. Since the nozzle part 37 has a length which exceeds the length of two consecutive packages and substantially corresponds to the length of three consecutive packages, the packing containers passing the nozzle will be filled gradually with contents as shown in FIG. 2, where the degree of filling at a certain moment is indicated by the liquid surfaces designated by numeral 44. Owing to this filling of several packing containers at the same time, the rate of flow in the nozzle part 37 can be kept lower, with the consequence that the risk of froth formation and lump formation (especially in whipping cream) is eliminated with a milder treatment of the contents and more accurate filling of the packing containers.

In a modified embodiment (not shown on the drawing) the base plate 39 has been given a slight curvature in such a manner that its two longitudinal edges provided with vanes are at a shorter distance from the central portion of the packing material web 5 than the central portion of the base plate 39. As a result, the jets of contents flowing through the outflow channels will be directed somewhat upwards towards the central portion of the packing material web 5 so that the flow will pass along the packing material (that is to say, the central portion of the packing material web 5 and the folded down lugs 5*a*) as long as possible, which has been found to give rise to a certain deaeration of the contents and liberation of the air bubbles which previously may have blended into the liquid.

A somewhat modified embodiment of the nozzle part shown in FIG. 3 is illustrated in FIG. 4. The two nozzles have the same main features and in principle function in the same way, the difference mainly consisting in that the nozzle part shown in FIG. 4 has been given a more favourable form with regard to flow characteristics. This has been done, inter alia, in that the end parts of the guide vanes 40 facing the centre line have been curved in the direction of the orifice of the delivery pipe 38 so that they are able in a more supple manner to deflect the contents jet without at the same time creating turbulence in the same. Moreover, the vanes have been given a more accurate streamline shape and the vane cross-section substantially corresponds to the known guide vane cross-section which can be found e.g. in water turbines. The other parts of the nozzle part e.g. in vane 41 and the transition area 43 between the delivery pipe and the nozzle part have also been provided with radii to ensure the presence of laminar flow to the greatest possible extent.

The shape, position and distribution of the guide vanes must of course be adapted to the contents, for which the nozzle part is to be used, in the sense that a more delicate material, which e.g. tends to form lumps or otherwise changes viscosity during mechanical processing (e.g. whipping cream), requires a nozzle part with a more accurate (and also more expansive) design with regard to flow characteristics, whilst for less problematical contents the cheaper design as shown in FIG. 3 may be quite sufficient. It is, of course, also possible to design nozzle parts in a manner other than those shown in the two figures and it is conceivable e.g. that in certain connections a positioning of the straight guide vanes in FIG. 3 at a certain angle may be advantageous, this angular position possibly being varied along the length of the nozzle part.

The gradually diminishing height of the guide vanes 40 along the length of the nozzle part, and the reduction caused thereby in the cross-sectional areas of the outflow channels have proved to give a uniform outflow of contents along the entire length of the nozzle if the diminution of height is linear. In the case of certain very mobile products, however, it may be appropriate to provide a more rapid diminution of the guide vane height in the direction of the bottom end of the nozzle, so as to prevent an excessive part of contents to flow out at the bottom end of the nozzle. Here, too, of course, an adaptation of ths shape of the nozzle to the actual contents is required.

The shapes of nozzle described are particularly suitable for highly viscous contents which tend to form lumps or whose viscosity increases with mechanical processing. The filler pipe is particularly suitable, moreover, for the filling of not totally filled packages, since the accurately controlled successive filling of the packages wandering past, which is illustrated in FIG. 2 gives a very great accuracy of volume in the finished packing container.

The manufacture of totally filled packages containing readily frothing contents of low viscosity involves special problems. To ensure total filling of the packages it is of prime importance that the air bubbles which are unavoidably mixed into the contents during the filling procedure are given the opportunity of escaping from the packing container before the same is finally sealed, since they will otherwise collect in the package and form an air pocket.

The realization of the filler pipe in accordance with the invention shown in FIGS. 5 and 6 has been specially constructed to make possible the total filling of packing containers with low-viscosity contents. To facilitate the escape of the previously mentioned air bubbles formed during filling, which must escape upwards through the row of connected packing containers between the material webs 5 and 6 also containing the filler pipe, the nozzle part has been given a special design whilst at the same time the total length of the filler pipe has been reduced. The latter means that when the filler pipe is in installed condition in the machine the bottom end of the nozzle will be, instead of just underneath the compression tool 36 as shown in FIG. 2, at a distance in front of the same which corresponds to the length of two consecutive packing containers. In this way a larger space for the escape of air bubbles from the packing containers which at a certain moment are underneath the compression tool is created.

As is evident from FIGS. 5 and 6 this version of the filler pipe in accordance with the invention comprises a delivery pipe 38 and a nozzle part 37. The nozzle part 37 comprises a base plate 39 and partitions or guide vanes 40 arranged transversely over the same. The baseplate 39 is provided with a great number of through-holes 45 which are of oblong rectangular shape and are situated with their longitudinal axis at an angle of 90° to the centre axis of the filler pipe. The delivery pipe 38 opens into an elongated distribution chamber 42 situated underneath the baseplate 39 which via the holes 45 in the baseplate communicates with the space formed between the partitions or guide vanes 40. The distribution chamber 42 has a substantially oblong or rectangular cross-section, which at the end connected to the delivery pipe substantially corresponds to the cross-section of the delivery pipe. The height of the distribution chamber 42 diminishes gradually and linearly in the direction of the end of the distribution chamber remote from the delivery pipe (FIG. 5), which is achieved in that the rear wall of the distribution chamber opposite the baseplate extends at an angle to the centre axis of the filler pipe, whilst the baseplate 39 extends parallel with the centre axis of the filler pipe. When the filler pipe is in installed position in the packing machine, the nozzle 37, as mentioned earlier, will be at some distance (approx. two packing container lengths) above or in front of the compression tool 36. The central portion of the material web 5 and the portions of the material web 6 situated above the top surfaces of the moulds 12 thus run parallel with one another on passing the whole length of the nozzle part 37, since only thereafter they commence to be guided towards each other with the help of the shaping tool 36 which gradually brings the central portion of the material web 5 into contact with the portions of the material web 6 situated above the top surfaces. As a result any air bubbles remaining can rise freely through the free passages between the packing containers immediately before these are sealed. The air then passes upwards through the row of packing units where the space between the two material webs 5 and 6 is somewhat greater, but is partly taken up on the other hand by the delivery pipe and the nozzle part. However, thanks to the design of the nozzle as shown in FIGS. 5 and 6, the air is given the opportunity of passing the nozzle part without being affected by the contents issuing sideways from the nozzle, since these first flow into the narrow gap which is formed between the base plate 39 and the material web 5 resting against the upper side of the guide vanes 40, to flow subsequently sideways along the central portion of the material web 5 and down along the inside of the lugs 5*a*. The air can thus flow fairly freely into the space between the back, placed at an angle, of the nozzle part 37 and the upper surfaces of the moulds 12. Above the nozzle part 37 the air can then flow further in the channels which are formed between the packing material webs on both sides of the delivery pipe 38, to issue finally from the row of packing containers at the upper, open end of the same.

The central portion of the packing material web, which is situated between the lugs 5*a* connected to the edge zones of the material web 6, is somewhat arched, owing to the filler pipe situated between the two material webs, and in order to optimize the effect of the partitions or guide vanes 40, it is appropriate therefore to give these also a correspondingly arched shape, which in the case of the embodiment shown in FIGS. 5 and 6 also applies to the perforated base plate 39. By ensuring in this manner contact between the central portion of the packing material web 5 and the guide vanes, the flow of contents from the nozzle part takes place exclusively transversely which provides maximum opportunity for the air to escape upwards alongside the filler pipe.

We claim:

1. In a packing machine having a row of mutually connected packing containers to be filled with liquid contents, the improvement comprising a filler pipe having a delivery pipe and a nozzle part, the nozzle part comprising an elongated baseplate having means for conducting a liquid in fluid communication with the delivery pipe, said baseplate being provided on one side with a plurality of guide vanes that are constructed and arranged to form a plurality of channels in fluid communication with the means for conducting the liquid, each of the channels being directed at an angle to a longitudinal direction of the filler pipe and having an outlet in fluid communication with at least one of the packing containers.

2. The packing machine of claim 1 wherein the outlet end of the delivery pipe has the form of a distribution chamber situated underneath the baseplate, and wherein the means for conducting the liquid comprises a plurality of perforations in the baseplate to allow a flow of liquid from the interior of the distribution chamber to the channels formed by the guide vanes.

3. The packing machine of claim 2 wherein the guide vanes are comprised of transverse partitions extending between the longitudinal side edges of the baseplate.

4. The packing machine of claim 1 wherein the delivery pipe opens at one end of an upper side of the baseplate.

5. The packing machine of claim 4 wherein the guide vanes are in the form of partitions projecting from the surface of the baseplate which extend from the longitudinal edges of the baseplate in the direction of the longitudinal centre line of the plate.

6. The packing machine of claim 5 wherein the means for conducting the liquid comprises a central, substantially triangular portion which is free of guide vanes.

7. The packing machine of claim 6 wherein the triangular portion is limited by the end parts of the guide vanes facing towards the centre line of the baseplate and by the orifice of the delivery pipe.

8. The packing machine in accordance with any one of the claims 4–7, wherein the outlets of the plurality of channels extend over a distance which corresponds to the length of at least two consecutive packing containers.

9. The packing machine of claim 8 wherein end parts of the guide vanes facing towards the centre line of the baseplate are curved in the direction of the opening of the delivery pipe.

10. The packing machine of any one of claims 4–7 wherein the height of the guide vanes gradually diminishes from a height corresponding to the thickness of the delivery pipe at the end of the nozzle part adjoining the delivery pipe to a height corresponding to the thickness of the baseplate at the opposite end of the nozzle part.

11. The packing machine of claim 1 wherein the nozzle part supports a portion of the material forming the packing container.

* * * * *